US010203709B1

(12) United States Patent
Feng et al.

(10) Patent No.: US 10,203,709 B1
(45) Date of Patent: Feb. 12, 2019

(54) LOW DROPOUT REGULATOR AND METHOD FOR CONTROLLING THE SAME

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Xuehuan Feng, Beijing (CN); Wei Chen, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/984,313

(22) Filed: May 18, 2018

(30) Foreign Application Priority Data

Nov. 17, 2017 (CN) ..... 2017 1 1153338

(51) Int. Cl.

| | |
|---|---|
| ***G05F 1/575*** | (2006.01) |
| ***G05F 1/59*** | (2006.01) |
| ***G05F 1/46*** | (2006.01) |
| ***G05F 1/565*** | (2006.01) |

(52) U.S. Cl.
CPC ..... *G05F 1/575* (2013.01); *G05F 1/461* (2013.01); *G05F 1/468* (2013.01); *G05F 1/565* (2013.01); *G05F 1/59* (2013.01)

(58) Field of Classification Search
CPC ..... G05F 1/461; G05F 1/565; G05F 1/575; G05F 1/468; G05F 1/59
See application file for complete search history.

(56) References Cited

U.S. PATENT DOCUMENTS 8,063,805 B1 * 11/2011 Eid ..... G05F 1/56 341/142
9,172,984 B2 * 10/2015 Levicki ..... H04N 21/2541
2014/0285165 A1 * 9/2014 Wang ..... G05F 1/56 323/274

* cited by examiner

*Primary Examiner* — Timothy J Dole
*Assistant Examiner* — Ishrat Jamali
(74) *Attorney, Agent, or Firm* — Kinney & Lange, P.A.

(57) ABSTRACT

The embodiments of the present disclosure disclose a low dropout regulator and a method for controlling the same. The low dropout regulator comprises a control circuit configured to compare a output voltage with a first threshold voltage and a second threshold voltage, generate a first control signal when the output voltage is less than the first threshold voltage or greater than the second threshold voltage and a second control signal when the output voltage is greater than the first threshold voltage and less than the second threshold voltage; a digital regulator circuit configured to adjust the output voltage according to the first control signal and maintain the output voltage according to the second control signal; and an analog regulator circuit configured to output feedback current to the output terminal according to the output voltage and the reference voltage under the trigger of the second control signal.

10 Claims, 3 Drawing Sheets

LOW DROPOUT REGULATOR AND METHOD FOR CONTROLLING THE SAME

CROSS-REFERENCE TO RELATED APPLICATION(S)

This application claims priority to the Chinese Patent Application No. 201711153338.0, filed on Nov. 17, 2017, entitled "LOW DROPOUT REGULATOR AND METHOD FOR CONTROLLING THE SAME", which is incorporated herein by reference in its entirety.

TECHNICAL FIELD

The embodiments of the present disclosure relate to the field of power management technology, and more particularly, to a low dropout regulator and a method for controlling the same.

BACKGROUND

Currently, Low Dropout Regulators (LDOs for short), as power management circuits, have been widely used in fields such as portable electronic devices, wireless energy transmission systems, etc. The LDOs may be categorized into analog LDOs and digital LDOs according to characteristics of circuits. The analog LDOs have advantages such as a small output ripple, a high response speed etc., but due to their characteristics of analog circuits, their process migration performance is poor and their occupied chip area is large. In contrast, the digital LDOs have advantages such as good process migration performance and a small occupied chip area, and have disadvantages such as a large output ripple and a low response speed.

SUMMARY

It is found through research that there is no low dropout regulator which can have all of the advantages such as good process migration performance, a small occupied chip area, and a small output ripple. In order to at least partially solve or alleviate the above technical problems, the embodiments of the present disclosure provide a low dropout regulator and a method for controlling the same.

In an aspect, the embodiments of the present disclosure provide a low dropout regulator, comprising a control circuit, a digital regulator circuit and an analog regulator circuit, wherein the control circuit is communicatively connected to an output terminal of the low dropout regulator and is configured to receive a first threshold voltage, a second threshold voltage, a reference voltage, and an output voltage output by the output terminal, compare the output voltage with the first threshold voltage, compare the output voltage with the second threshold voltage, generate a first control signal in a state where the output voltage is less than the first threshold voltage or greater than the second threshold voltage and generate a second control signal in a state where the output voltage is greater than the first threshold voltage and less than the second threshold voltage;

the digital regulator circuit is communicatively connected to the control circuit and is configured to adjust the output voltage according to the first control signal so that the output voltage is equal to the reference voltage, and maintain the output voltage according to the second control signal; and the analog regulator circuit is communicatively connected to the control circuit and is configured to output feedback current to the output terminal according to the output voltage and the reference voltage under the trigger of the second control signal to reduce an output ripple, wherein the reference voltage is greater than the first threshold voltage, and the reference voltage is less than the second threshold voltage.

Alternatively, the control circuit comprises a comparison circuit, an encoding circuit, a clock frequency control circuit, a plurality of switches, and a switch control circuit configured to control the plurality of switches, wherein the comparison circuit is communicatively connected to the output terminal of the low dropout regulator and is configured to compare the output voltage with the first threshold voltage, compare the output voltage with the second threshold voltage, compare the output voltage with the reference voltage, and output comparison results to the encoding circuit;

the encoding circuit is communicatively connected to the comparison circuit and is configured to output a first code in a state where the output voltage is less than the first threshold voltage or greater than the second threshold voltage, and output a second code in a state where the output voltage is greater than the first threshold voltage and less than the second threshold voltage;

the clock frequency control circuit is communicatively connected to the encoding circuit and is configured to generate a high frequency clock signal according to the first code and generate an intermediate frequency clock signal according to the second code;

the switch control circuit is communicatively connected to the encoding circuit and is configured to generate a first signal for controlling all the plurality of switches to be turned off according to the first code, and generate a second signal for controlling all the plurality of switches to be turned on according to the second code, wherein the plurality of switches are connected to the analog regulator circuit; and the first control signal comprises the high frequency clock signal and the first signal, and the second control signal comprises the intermediate frequency clock signal and the second signal.

Alternatively, the comparison circuit comprises a first comparator, a second comparator and a third comparator, wherein the first comparator has a positive input terminal configured to input the first threshold voltage, and a negative input terminal configured to input the output voltage output by the output terminal;

the second comparator has a positive input terminal configured to input the reference voltage, and a negative input terminal configured to input the output voltage output by the output terminal; and the third comparator has a positive input terminal configured to input the second threshold voltage, and a negative input terminal configured to input the output voltage output by the output terminal.

Alternatively, the digital regulator circuit comprises a counting circuit, a decoding circuit and an array of transistors, wherein the counting circuit is communicatively connected to the comparison circuit and is configured to generate a third control signal according to the comparison result of the comparison circuit and the high frequency clock signal; and the decoding circuit is communicatively connected to the counting circuit and is configured to control a number of transistors to be turned on in the array of transistors according to the third control signal.

Alternatively, the transistors in the array of transistors comprise P-channel metal oxide semiconductor transistors, and/or N-channel metal oxide semiconductor transistors, and/or thin film transistors.

Alternatively, the analog regulator circuit comprises an amplifying circuit and a power transistor, wherein the amplifying circuit has a positive input terminal configured to input the reference voltage, and a negative input terminal configured to input the output voltage output by the output terminal, and is configured to amplify the reference voltage and the output voltage; and the power transistor is communicatively connected to the amplifying circuit and is configured to generate the feedback current according to the amplified reference voltage and the amplified output voltage.

Alternatively, the low dropout regulator further comprises: a feedback resistor network and a capacitor, wherein the feedback resistor network has a first terminal connected to the output terminal of the low dropout regulator, and a second terminal connected to the ground, and is configured to shunt current output by the output terminal of the low dropout regulator; and the capacitor has a first terminal connected to the output terminal of the low dropout regulator, and a second end connected to the ground, and is configured to regulate the voltage output by the output terminal of the low dropout regulator.

In another aspect, the embodiments of the present disclosure further provide a method for controlling a low dropout regulator, wherein the low dropout regulator is the low dropout regulator according to claim 1, the method comprising:

receiving a first threshold voltage, a second threshold voltage, a reference voltage and an output voltage output by the output terminal of the low dropout regulator;

comparing the output voltage with the first threshold voltage and comparing the output voltage with the second threshold voltage;

generating a first control signal in a state where the output voltage is less than the first threshold voltage or greater than the second threshold voltage, and adjusting the output voltage according to the first control signal so that the output voltage is equal to the reference voltage; and generating a second control signal in a state where the output voltage is greater than the first threshold voltage and less than the second threshold voltage, maintaining the output voltage according to the second control signal, and outputting feedback current to the output terminal according to the output voltage and the reference voltage under the trigger of the second control signal to reduce an output ripple;

wherein, the reference voltage is greater than the first threshold voltage, and the reference voltage is less than the second threshold voltage.

Alternatively, generating a first control signal in a state where the output voltage is less than the first threshold voltage or greater than the second threshold voltage comprises:

outputting a first code in a state where the output voltage is less than the first threshold voltage or greater than the second threshold voltage; and generating a first control signal comprising a high frequency clock signal and a first signal for controlling all the plurality of switches to be turned off according to the first code;

and adjusting the output voltage according to the first control signal comprises:

generating a third control signal according to a comparison result of the comparison circuit and the high frequency clock signal; and controlling a number of transistors to be turned on in the array of transistors according to the third control signal.

Alternatively, generating a second control signal in a state where the output voltage is greater than the first threshold voltage and less than the second threshold voltage comprises:

outputting a second code in a state where the output voltage is greater than the first threshold voltage and less than the second threshold voltage; and generating the second control signal comprising an intermediate frequency clock signal and a second signal for controlling all the plurality of switches to be turned on according to the second code;

maintaining the output voltage according to the second control signal comprises:

maintaining the output voltage according to the intermediate frequency clock signal; and outputting feedback current to the output terminal according to the output voltage and the reference voltage comprises:

amplifying the reference voltage and the output voltage; and generating the feedback current according to the amplified reference voltage and the amplified output voltage.

BRIEF DESCRIPTION OF THE DRAWINGS

The accompanying drawings are used to provide a further understanding of the technical solutions of the present disclosure and constitute a part of the specification. The accompanying drawings are used together with the embodiments of the present application to explain the technical solutions of the present disclosure and do not constitute limitations on the technical solutions of the present disclosure.

DETAILED DESCRIPTION

In order to make the purposes, technical solutions, and advantages of the present disclosure more clear, the embodiments of the present disclosure will be described in detail below with reference to the accompanying drawings. It should be illustrated that the embodiments in the present application and the features in the embodiments can be combined with each other arbitrarily without conflict.

In the embodiments described below, communication connections comprise connections through a wireless network, a wired network, and/or any combination thereof.

Networks may comprise a local area network, the Internet, a telecommunications network, an Internet of things based on the Internet and/or a telecommunications network, and/or any combination thereof. For example, the wired network may transmit information in a transmission manner, for example, using wire, twisted pair, coaxial cable, or optical fiber etc. For example, the wireless network may use communication manners, for example, using a WWAN mobile communication network, Bluetooth, Zigbee, or WiFi etc.

An output ripple is a phenomenon caused by a voltage fluctuation of a direct current regulated power supply. As the direct current regulated power supply is generally formed by an alternative current power supply, a rectifier, and a regulator etc., it is unavoidable that there are some alternative current components in a direct current stable amount. Such alternative current components superimposed on the direct current stable amount are called an output ripple.

"A and/or B" in this application means three choices, which are only A, or only B, or both A and B. That is, "and/or" may represent an "and" relationship, or may also represent an "or" relationship.

It should also be illustrated that words "first", "second", etc. in the present application are only used for distinguishing elements, and the words "first", "second" etc. are not intended to limit the elements in terms of numbers, execution orders, and importance, priority etc.

Figure 1:
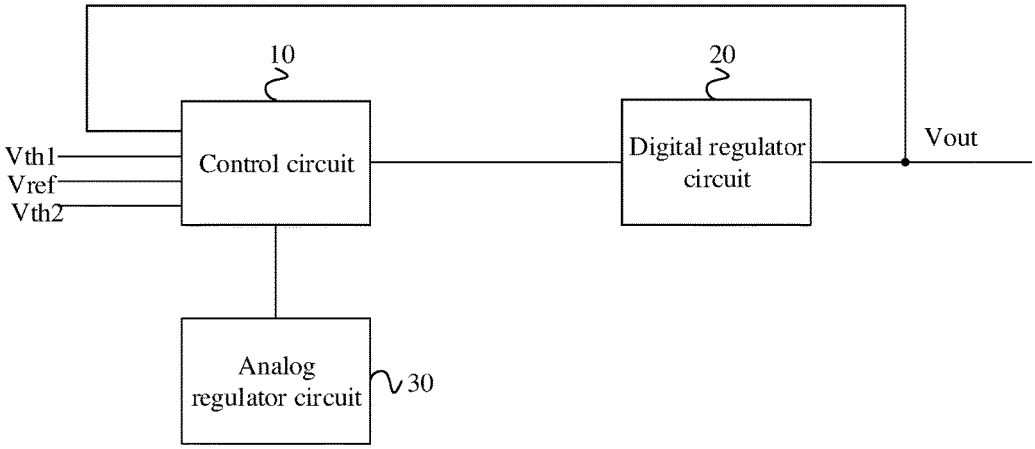
FIG. 1 is a structural diagram of a low dropout regulator according to an embodiment of the present disclosure.

FIG. 1 is a structural diagram of a low dropout regulator according to an embodiment of the present disclosure. As shown in FIG. 1, the low dropout regulator according to the embodiment of the present disclosure may comprise a control circuit 10, a digital regulator circuit 20 connected to the control circuit 10 and an analog regulator circuit 30 connected to the control circuit 10.

Specifically, the control circuit 10 is communicatively connected to an output terminal of the low dropout regulator and is configured to receive a first threshold voltage Vth1, a second threshold voltage Vth2, a reference voltage Vref, and an output voltage Vout output by the output terminal, compare the output voltage Vout with the first threshold voltage Vth1, compare the output voltage Vout with the second threshold voltage Vth2, generate a first control signal in a state where the output voltage Vout is less than the first threshold voltage Vth1 or greater than the second threshold voltage Vth2, and generate a second control signal in a state where the output voltage Vout is greater than the first threshold voltage Vth1 and less than the second threshold Vth2. In addition, in a case where the output voltage Vout is equal to one of the first threshold voltage Vth1 or the second threshold voltage Vth2, the first control signal or the second control signal may be selectively generated, depending on a specific implementation, which is not limited in the present disclosure. For example, in some embodiments, when the output voltage Vout is equal to the first threshold voltage Vth1, the first control signal may be generated, or the second control signal may also be generated, depending entirely on specific design requirements. Similarly, in some embodiments, when the output voltage Vout is equal to the second threshold voltage Vth2, the first control signal may be generated, or the second control signal may also be generated.

Specifically, in the embodiment shown in FIG. 1, the reference voltage Vref is greater than the first threshold voltage Vth1, and the reference voltage Vref is less than the second threshold voltage Vth2; however the present disclosure is not limited thereto. In other words, an embodiment in which the first threshold voltage Vth1 is greater than the reference voltage Vref and the reference voltage Vref is greater than the second threshold voltage Vth2 may also be realized, in which case it only needs to correspondingly adjust a circuit design. It should be illustrated that an absolute value of a difference between the first threshold voltage Vth1 and the reference voltage Vref may be equal to an acceptable error. Similarly, an absolute value of a difference between the second threshold voltage Vth2 and the reference voltage Vref may be equal to an acceptable error.

The digital regulator circuit 20 is configured to adjust the output voltage Vout according to the first control signal so that the output voltage Vout is equal to the reference voltage Vref. In addition, the digital regulator circuit 20 may further be configured to maintain the output voltage according to the second control signal.

The analog regulator circuit 30 is configured to output feedback current to the output terminal according to the output voltage Vout and the reference voltage Vref under the trigger of the second control signal to reduce an output ripple.

The low dropout regulator according to the embodiment of the present disclosure comprises the control circuit 10 configured to receive the first threshold voltage Vth1, the second threshold voltage Vth2, the reference voltage Vref, and the output voltage Vout output by the output terminal, compare the output voltage Vout with the first threshold voltage Vth1, compare the output voltage Vout with the second threshold voltage Vth2, generate a first control signal in a state where the output voltage Vout is less than the first threshold voltage Vth1 or greater than the second threshold voltage Vth2, and generate a second control signal in a state where the output voltage Vout is greater than the first threshold voltage Vth1 and less than the second threshold voltage Vth2; the digital regulator circuit 20 configured to adjust the output voltage Vout according to the first control signal so that the output voltage Vout is equal to the reference voltage Vref, and maintain the output voltage Vout according to the second control signal; and the analog regulator circuit 30 configured to output feedback current to the output terminal according to the output voltage Vout and the reference voltage Vref under the trigger of the second control signal to reduce an output ripple. The technical solution according to the embodiment of the present disclosure is a digital-analog hybrid low dropout regulator. When the output voltage Vout is not close to the reference voltage Vref, the output voltage is regulated by the digital regulator circuit 20. When the output voltage Vout is close to the reference voltage Vref, feedback current is output by the analog regulator circuit 30 to eliminate a ripple output by the digital regulator circuit, so that the output ripple is small. In addition, the analog regulator circuit 30 only needs to obtain small feedback current according to the output voltage Vout and the reference voltage Vref, which avoids a complex feedback loop from being provided in the analog regulator circuit 30, so that the low dropout regulator has a small occupied chip area and good process migration performance.

Figure 2:
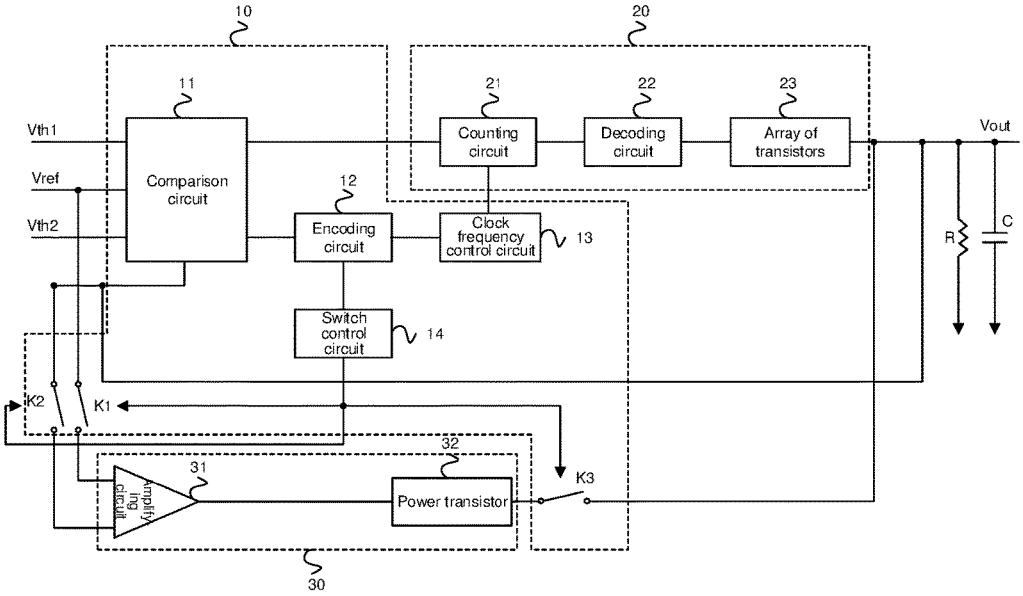
FIG. 2 is another structural diagram of a low dropout regulator according to an embodiment of the present disclosure.
Figure 3:
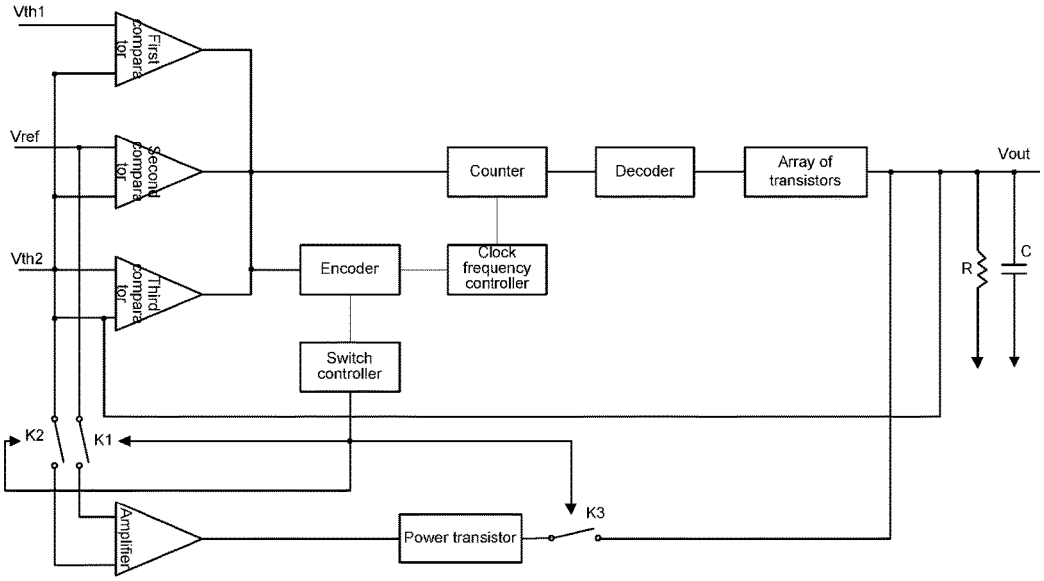
FIG. 3 is an equivalent circuit diagram of a low dropout regulator according to an embodiment of the present disclosure.

Alternatively, FIG. 2 is another structural diagram of a low dropout regulator according to an embodiment of the present disclosure, and FIG. 3 is an equivalent circuit diagram of a low dropout regulator according to an embodiment of the present disclosure. As shown in FIGS. 2 and 3, the control circuit 10 may comprise a comparison circuit 11, an encoding circuit 12, a clock frequency control circuit 13, a plurality of switches (for example, K1, K2, K3, etc.) and a switch control circuit 14 for controlling the plurality of switches.

Specifically, the comparison circuit 11 is communicatively connected to the output terminal of the low dropout regulator and is configured to compare the output voltage Vout with the first threshold voltage Vth1, compare the output voltage Vout with the second threshold voltage Vth2, compare the output voltage Vout with the reference voltage Vref, and output comparison results to the encoding circuit 12.

Alternatively, as shown in FIG. 3, the comparison circuit 11 may comprise a first comparator, a second comparator, and a third comparator.

The first comparator has a positive input terminal configured to input the first threshold voltage Vth1, and a negative input terminal configured to input the output voltage Vout output by the output terminal; the second comparator has a positive input terminal configured to input the reference voltage Vref, and a negative input terminal configured to input the output voltage Vout output by the output terminal; and the third comparator has a positive input terminal configured to input the second threshold voltage Vth2, and a negative input terminal configured to input the output voltage Vout output by the output terminal.

Alternatively, when the output voltage Vout is less than the first threshold voltage Vth1, a comparison result output by the first comparator is "0"; otherwise, when the output voltage Vout is greater than the first threshold voltage Vth1, the comparison result output by the first comparator is "1".

Alternatively, when the output voltage Vout is less than the reference voltage Vref, a comparison result output by the second comparator is "0"; otherwise, when the output voltage Vout is greater than the reference voltage Vref, the comparison result output by the second comparator is "1".

Alternatively, when the output voltage Vout is less than the second threshold voltage Vth2, a comparison result output by the third comparator is "0"; otherwise, when the output voltage Vout is greater than the second threshold voltage Vth2, the comparison result output by the third comparator is "1".

In addition, in a case where the output voltage is equal to one of the first threshold voltage Vth1, the second threshold voltage Vth2, and the reference voltage Vref, a comparator may be correspondingly selected to output 0 or 1, depending on a specific implementation, which is not limited in the present disclosure. For example, in some embodiments, when the output voltage Vout is equal to the first threshold voltage Vth1, the first comparator may output "0" or may also output "1", depending on a specific design of the first comparator. Similarly, in some embodiments, when the output voltage Vout is equal to the second threshold voltage Vth2, the third comparator may output "0" or may also output "1". Similarly, in some embodiments, when the output voltage Vout is equal to the reference voltage Vref, the second comparator may output "0" or may also output "1".

It can be known from the above description that, there are only four cases of the output result of the comparison circuit 11, which are as follows respectively. If the output voltage Vout is less than the first threshold voltage Vth1, the comparison result output by the comparison circuit 11 is "000", if the output voltage Vout is greater than the second threshold voltage Vth2, the comparison result output by the comparison circuit 11 is "111", if the output voltage Vout is greater than the first threshold voltage Vth1 and less than the reference voltage Vref, the comparison result output by the comparison circuit 11 is "100", and if the output voltage Vout is greater than the reference voltage Vref and less than the second threshold voltage Vth2, the comparison result output by the comparison circuit 11 is "110".

The encoding circuit 12 is communicatively connected to the comparison circuit 11 and is configured to output a first code in a state where the output voltage Vout is less than the first threshold voltage Vth1 or greater than the second threshold voltage Vth2, and output a second code in a state where the output voltage Vout is greater than the first threshold voltage Vth1 and less than the second threshold voltage Vth2. It should be illustrated that the encoding circuit 12 may be implemented using an encoder.

Specifically, the encoding circuit 12 correspondingly performs encoding according to the comparison results of the output voltage Vout with the first threshold voltage Vth1 and the second threshold voltage Vth2, wherein the first code comprises"00" or "11" and the second code comprises "01" or "10".

The clock frequency control circuit 13 is communicatively connected to the encoding circuit 12 and is configured to generate a high frequency clock signal according to the first code, and generate an intermediate frequency clock signal according to the second code. It should be illustrated that the clock frequency control circuit 13 may be implemented using a clock frequency controller.

The switch control circuit 14 is communicatively connected to the encoding circuit 12 and is configured to generate a first signal for controlling all the plurality of switches to be turned off according to the first code, and generate a second signal for controlling all the plurality of switches to be turned on according to the second code. It should be illustrated that the switch control circuit 14 may be implemented using a switch controller.

A plurality of switches are connected to the analog regulator circuit 30. It should be illustrated that there may be two or three switches. If there are two switches which are specifically a first switch and a second switch, the reference voltage Vref is input to the analog regulator circuit 30 through the first switch, and the output voltage Vout is input to the analog regulator circuit 30 through the second switch. If there are three switches which are specifically, for example, a first switch K1, a second switch K2 and a third switch K3 shown in FIG. 3, a connection relationship between the first switch K1 and the second switch K2 is the same as that when there are two switches, and the analog regulator circuit 30 is connected to the output terminal of the low dropout regulator through the third switch K3. Specifically, FIG. 3 is depicted by taking three switches as an example.

Specifically, the first control signal comprises the high frequency clock signal and the first signal, and the second control signal comprises the intermediate frequency clock signal and the second signal.

Alternatively, the control circuit 10 further comprises an analog-to-digital conversion circuit configured to convert the output voltage Vout output by the output terminal into a digital signal and output the digital signal to the comparison circuit 11. The analog-to-digital conversion circuit may be implemented using an analog-to-digital converter. There may be a case where a plurality of comparators share one analog-to-digital converter, or various comparators use respective analog-to-digital converters.

Alternatively, the digital regulator circuit 20 comprises a counting circuit 21 communicatively connected to the comparison circuit 11, a decoding circuit 22 communicatively connected to the counting circuit 21, and an array of transistors 23 communicatively connected to the decoding circuit 22.

The counting circuit 21 is configured to generate a third control signal according to the comparison result of the comparison circuit and the high frequency clock signal. The counting circuit may be implemented using a counter.

Specifically, the counter obtains a clock cycle according to the high frequency clock signal.

As an example, the counter is composed of a basic counting element and some control gates, and the counting element is composed of a series of various types of triggers having functions of storing information. These triggers comprise an RS trigger, a T trigger, and a D trigger, i.e., a JK trigger etc. It can not only record a number of output clock pulses, but also can realize frequency division and timing and generate beat pulses and pulse sequences etc. For example, counters are used in timing generators, frequency dividers, instruction counters etc. in computers. There are many types of counters. According to different clock pulse input methods, the counters may be categorized into synchronous counters and asynchronous counters; according to different carry-systems, the counters may be categorized into binary counters and non-binary counters; and according to different increase/decrease trends in numbers in a counting process, the counters may be categorized into up-counters, down-counters and reversible counters.

The decoding circuit 22 is configured to control a number of transistors to be turned on in the array of transistors 23 according to the third control signal. Specifically, the decoding circuit 22 may be implemented using a decoder.

The transistors in the array of transistors 23 comprise P-channel Metal Oxide Semiconductor (PMOS) transistors, and/or N-channel Metal Oxide Semiconductor (NMOS) transistors and/or Thin-Film Transistors (TFTs). If the array of transistors 23 is a PMOS array, it comprises PMOS transistors which are turned off at a high level and are turned on at a low level. If the array of transistors 23 is an NMOS array, it comprises NMOS transistors which are turned on at a high level and are turned off at a low level.

Specifically, as shown in FIG. 3, the decoder judges a number of high level signals or low level signals through a signal transmitted by the counter, and controls a number of transistors to be turned on in the array of transistors.

Figure 4:
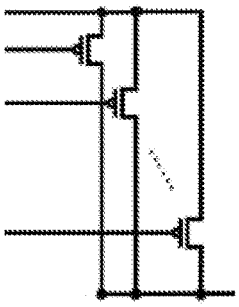
FIG. 4 is a diagram of an array of transistors in a low dropout regulator according to an embodiment of the present disclosure.

As an example, FIG. 4 is a diagram of an array of transistors 23 in a low dropout regulator according to an embodiment of the present disclosure. FIG. 4 is depicted by taking the array of transistors 23 composed of a plurality of PMOS transistors as an example. A decoder connected to an input terminal of the PMOS array is used to input M high level signals or M low level signals to the PMOS array. When M high level signals are input, there are M PMOS transistors to be turned off, and when M low level signals are input, there are M PMOS transistors to be turned on. If the array of transistors 23 is composed of a plurality of NMOS transistors, the decoder inputs M high level signals or M low level signals to the NMOS array. When M high level signals are input, there are M NMOS transistors to be turned on, and when M low level signals are input, there are M NMOS transistors to be turns off.

Specifically, a value in a counter is incremented by 1 each time a rising edge of a clock arrives. As a number of transistors to be turned on gradually increases, the output voltage gradually increases.

Alternatively, the analog regulator circuit 30 comprises an amplifying circuit 31 and a power transistor 32 communicatively connected to the amplifying circuit 31.

The amplifying circuit 31 has a positive input terminal configured to input the reference voltage Vref, and a negative input terminal configured to input the output voltage Vout output by the output terminal, and is configured to amplify the reference voltage Vref and the output voltage Vout. The amplifying circuit 31 may be implemented using an amplifier.

The power transistor 32 is configured to generate feedback current according to the amplified reference voltage Vref and the amplified output voltage Vout.

Alternatively, the low dropout regulator according to the embodiment of the present disclosure further comprises a feedback resistor network R and a capacitor C.

The feedback resistor network R has a first terminal connected to the output terminal of the low dropout regulator, and a second terminal connected to the ground, and is configured to shunt current output by the output terminal of the low dropout regulator.

As an example, the feedback resistor network R comprises a resistor configured to shunt the current at the output terminal of the array of transistors in order to prevent internal devices from being damaged due to excessive current of the low dropout regulator. Further, the feedback resistor network may also comprise two or more resistors which may be connected in any connection manner. Resistors in the feedback resistor network and their mutual connection manners are not limited in the embodiments of the present disclosure, as long as they can achieve the function of shunting the current at the output terminal of the array of transistors.

The capacitor C has a first terminal connected to the output terminal of the low dropout regulator and a second terminal connected to the ground, and is configured to regulate the voltage output by the output terminal of the low dropout regulator.

The technical solutions of the present disclosure are further described through the working principle of the low dropout regulator in combination with FIGS. 3 and 4.

When the low dropout regulator starts to work, that is, when the output voltage Vout is 0, the output voltage Vout<the first threshold voltage Vth1, then the first comparator outputs "0", the output voltage Vout<the reference voltage Vref, then the second comparator outputs "0", the output voltage Vout<the second threshold voltage Vth2, then the third comparator outputs "0", the encoder outputs "00", and the switch controller controls three switches K1, K2 and K3 to be turned off according to"00" output by the encoder. At this time, the analog regulator circuit 30 does not work, the clock frequency controller controls to output a high frequency clock signal according to "00" output by the encoder, so that the digital regulator circuit 20 adjusts the output voltage Vout to be close to the reference voltage Vref. Specifically, the counter outputs a control signal according to "000" output by the comparator, and the decoder controls a number of transistors to be turned on in the array of transistors 23 according to the control signal to adjust the output voltage Vout. When the output voltage Vout is excessive, the output voltage Vout>the first threshold voltage Vth1, then the first comparator outputs "1", the output voltage Vout>the reference voltage Vref, then the second comparator outputs "1", the output voltage Vout>the second threshold voltage Vth2, then the third comparator output "1", the encoder output "11", and the switch controller controls the three switches K1, K2, and K3 to be turned off according to "11" output by the encoder. At this time, the analog regulator circuit 30 does not work, and the clock frequency controller controls to output a high frequency clock signal according to "11" output by the encoder, so that the digital regulator circuit 20 adjusts the output voltage Vout to be close to the reference voltage Vref. When the output voltage Vout is greater than the first threshold voltage Vth1 and less than the second threshold voltage Vth2, the encoder outputs "01" or "10". The switch controller controls the three switches to be turned on according to the output of the encoder, and at this time, the analog regulator circuit 30 starts to work, and the clock frequency controller controls to output an intermediate frequency clock signal according to the output of the encoder. At this time, the analog regulator circuit 30 and the digital regulator circuit 20 cooperate to work. Firstly, the array of transistors 23 of the digital regulator circuit 20 maintains the output voltage Vout which has been substantially the same as the reference voltage Vref. As a switching action of the array of transistors 23 makes the output ripple larger, the analog regulator circuit 30 outputs the output voltage Vout and the reference voltage Vref to the power transistor 32 through the amplifier, and outputs feedback current to the output terminal to eliminate the excessive ripple in the output voltage of the digital regulator circuit 20, so that the output ripple tends to be stable.

The various circuits according to the embodiments of the present disclosure may be implemented using general computing apparatuses. They may be centralized in a single computing apparatus or may be distributed over a network of multiple computing apparatuses. Alternatively, they may be implemented using program codes executable by a computing apparatus. Thereby, they may be stored in a storage apparatus to be executed by the computing apparatus, and in some cases, the steps shown or described may be performed in an order other than that here, or they may be made into various integrated circuits, or multiple circuits or steps therein may be implemented as a single integrated circuit.

Figure 5:
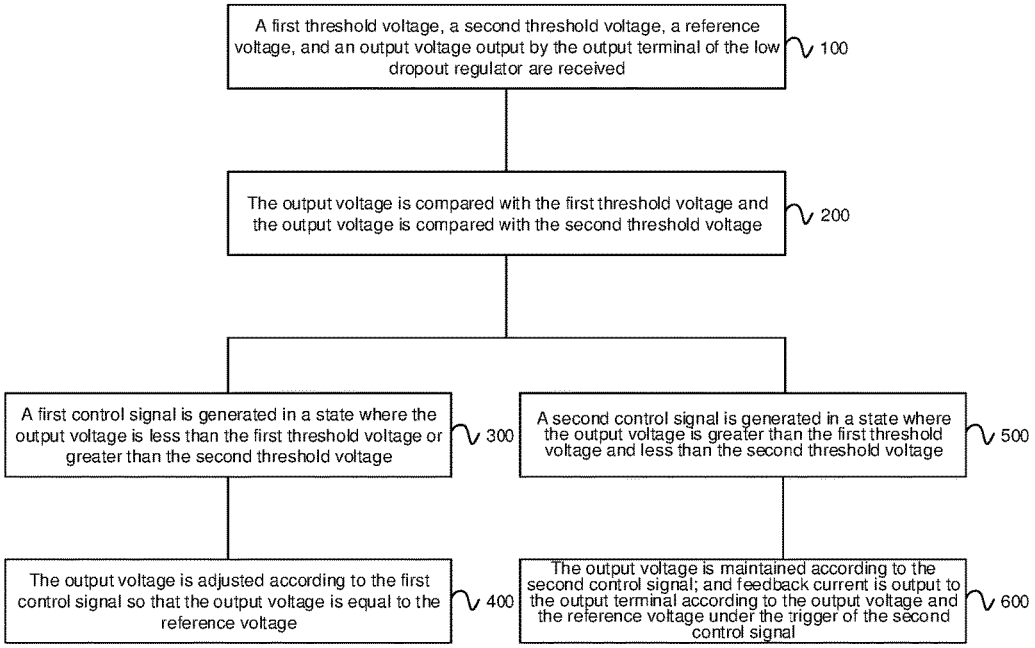
FIG. 5 is a flowchart of a method for controlling a low dropout regulator according to an embodiment of the present disclosure.

Based on the concept of the embodiments described above, FIG. 5 is a flowchart of a method for controlling a low dropout regulator according to an embodiment of the present disclosure. As shown in FIG. 5, the method for controlling a low dropout regulator according to the embodiment of the present disclosure is used to control the low dropout regulator in the embodiments described above, and specifically comprises the following steps.

In step 100, a first threshold voltage Vth1, a second threshold voltage Vth2, a reference voltage Vref, and an output voltage Vout output by the output terminal of the low dropout regulator are received.

In step 200, the output voltage Vout is compared with the first threshold voltage Vth1 and the output voltage Vout is compared with the second threshold voltage Vth2.

In step 300, a first control signal is generated in a state where the output voltage Vout is less than the first threshold voltage Vth1 or greater than the second threshold voltage Vth2.

Specifically, step 300 comprises: outputting a first code in a state where the output voltage Vout is less than the first threshold voltage Vth1 or greater than the second threshold voltage Vth2; and generating a first control signal comprising a high frequency clock signal and a first signal for controlling all the plurality of switches to be turned off according to the first code.

Alternatively, the first code comprises "00" or "11".

In step 400, the output voltage Vout is adjusted according to the first control signal so that the output voltage Vout is equal to the reference voltage Vref.

Specifically, step 400 comprises: generating a third control signal according to a comparison result of the comparison circuit 11 and the high frequency clock signal; and controlling a number of transistors to be turned on in the array of transistors 23 according to the third control signal.

The transistors in the array of transistors 23 comprise PMOS transistors, and/or NMOS transistors, and/or TFTs.

Specifically, the decoder judges a number of high level signals or low level signals through a signal transmitted by the counter and controls a number of transistors to be turned on in the array of transistors 23. If the array of transistors is a PMOS array, it comprises PMOS transistors which are turned off at a high level and are turned on at a low level. If the array of transistors 23 is an NMOS array, it comprises NMOS transistors which are turned on at a high level and are turned off at a low level.

In step 500, a second control signal is generated in a state where the output voltage Vout is greater than the first threshold voltage Vth1 and less than the second threshold voltage Vth2.

Specifically, step 500 comprises outputting a second code in a state where the output voltage Vout is greater than the first threshold voltage Vth1 and less than the second threshold voltage Vth2, and generating a second control signal comprising an intermediate frequency clock signal and a second signal for controlling all the plurality of switches to be turned on according to the second code.

Alternatively, the second code comprises "01" or "10"

In step 600, the output voltage Vout is maintained according to the second control signal; and feedback current is output to the output terminal according to the output voltage Vout and the reference voltage Vref under the trigger of the second control signal.

Specifically, maintaining the output voltage Vout according to the second control signal specifically comprises: maintaining the output voltage Vout according to the intermediate frequency clock signal. Outputting feedback current to the output terminal according to the output voltage Vout and the reference voltage Vref specifically comprises: amplifying the reference voltage Vref and the output voltage Vout; and generating the feedback current according to the amplified reference voltage Vref and the amplified output voltage Vout.

Alternatively, the reference voltage Vref is greater than the first threshold voltage Vth1, and the reference voltage Vref is less than the second threshold voltage Vth2.

The method for controlling a low dropout regulator according to the embodiment of the present disclosure is used to control a low dropout regulator, and specifically comprises: receiving the first threshold voltage Vth1, the second threshold voltage Vth2, the reference voltage Vref, and the output voltage Vout output by the output terminal, comparing the output voltage Vout with the first threshold voltage Vth1, comparing the output voltage Vout with the second threshold voltage Vth2, generating a first control signal in a state where the output voltage Vout is less than the first threshold voltage Vth1 or greater than the second threshold voltage Vth2 and adjusting the output voltage Vout according to the first control signal, so that the output voltage Vout is equal to the reference voltage Vref, generating a second control signal in a state where the output voltage Vout is greater than the first threshold voltage Vth1 and less than the second threshold voltage Vth2 and maintaining the output signal Vout according to the second control signal, and outputting feedback current to the output terminal according to the output voltage Vout and the reference voltage Vref under the trigger of the second control signal, to reduce an output ripple. In the technical solutions according to the embodiments of the present disclosure, when the output voltage Vout is not close to the reference voltage Vref, a stable output voltage Vout is achieved, and when the output voltage Vout is close to the reference voltage Vref, the feedback current is output to eliminate the output ripple of the output voltage Vout, so that the output ripple is small. In addition, it only needs to obtain small feedback current according to the output voltage Vout and the reference voltage Vref, to avoid a complicated feedback loop from being provided in the low dropout regulator, so that the low dropout regulator has a small occupied chip area and good process migration performance.

In addition, the method according to the embodiments of the present disclosure further comprises: shunting output current at the output terminal.

Specifically, in the embodiments of the present disclosure, the current at the output terminal of the array of transistors 23 is shunted in order to prevent the internal devices from being damaged due to excessive current of the low dropout regulator.

There are several explanations as follows.

The accompanying drawings of the embodiments of the present disclosure relate only to the structures involved in the embodiments of the present disclosure, and other structures can be known with reference to normal designs.

The embodiments of the present disclosure, that is, the features in the embodiments can be combined with each other to obtain new embodiments without a conflict.

Of course, any product or method of the present disclosure can be implemented without necessarily achieving all of the advantages described above at the same time. Other features and advantages of the present disclosure are set forth partly in the specification, and become obvious partly from the embodiments of the specification, or can be understood by practice of the present disclosure. The purposes and other advantages of the embodiments of the present disclosure can be realized and obtained at least partly by the structures particularly pointed out in the specification, the claims as well as the accompanying drawings.

Although the embodiments disclosed in the present disclosure are described as above, the content described is merely embodiments used for facilitating the understanding of the present disclosure and is not intended to limit the present disclosure. Any person skilled in the art to which the present disclosure pertains can make any modifications and changes in the form and details of implementation without departing from the spirit and scope disclosed in the present disclosure, but the patent protection scope of the present disclosure should still be defined by the scope of the attached claims.

We claim:

1. A low dropout regulator, comprising a control circuit, a digital regulator circuit, and an analog regulator circuit, wherein the control circuit is communicatively connected to an output terminal of the low dropout regulator and is configured to:

receive an output voltage output by the output terminal, a first threshold voltage, a second threshold voltage, and a reference voltage;

compare the output voltage with the first threshold voltage and compare the output voltage with the second threshold voltage;

generate a first control signal in a state where the output voltage is less than the first threshold voltage or greater than the second threshold voltage; and generate a second control signal in a state where the output voltage is greater than the first threshold voltage and less than the second threshold voltage, wherein the digital regulator circuit is communicatively connected to the control circuit and is configured to:

adjust the output voltage according to the first control signal so that the output voltage is equal to the reference voltage; and maintain the output voltage according to the second control signal, wherein the analog regulator circuit is communicatively connected to the control circuit and is configured to:

output feedback current to the output terminal according to the output voltage and the reference voltage under the trigger of the second control signal to reduce an output ripple, and wherein the reference voltage is greater than the first threshold voltage, and the reference voltage is less than the second threshold voltage.

2. The low dropout regulator according to claim 1, wherein the control circuit comprises a comparison circuit, an encoding circuit, a clock frequency control circuit, a plurality of switches, and a switch control circuit configured to control the plurality of switches, wherein the comparison circuit is communicatively connected to the output terminal of the low dropout regulator and is configured to:

compare the output voltage with the first threshold voltage;

compare the output voltage with the second threshold voltage;

compare the output voltage with the reference voltage; and output comparison results to the encoding circuit, wherein the encoding circuit is communicatively connected to the comparison circuit and is configured to:

output a first code in a state where the output voltage is less than the first threshold voltage or greater than the second threshold voltage; and output a second code in a state where the output voltage is greater than the first threshold voltage and less than the second threshold voltage, wherein the clock frequency control circuit is communicatively connected to the encoding circuit and is configured to:

generate a high frequency clock signal according to the first code; and generate an intermediate frequency clock signal according to the second code, wherein the switch control circuit is communicatively connected to the encoding circuit and is configured to:

generate a first signal for controlling all the plurality of switches to be turned off according to the first code; and generate a second signal for controlling all the plurality of switches to be turned on according to the second code, wherein the plurality of switches are connected to the analog regulator circuit; and wherein the first control signal comprises the high frequency clock signal and the first signal, and the second control signal comprises the intermediate frequency clock signal and the second signal.

3. The low dropout regulator according to claim 2, wherein the comparison circuit comprises a first comparator, a second comparator, and a third comparator, wherein the first comparator has a positive input terminal configured to input the first threshold voltage, and a negative input terminal configured to input the output voltage output by the output terminal;

wherein the second comparator has a positive input terminal configured to input the reference voltage, and a negative input terminal configured to input the output voltage output by the output terminal; and wherein the third comparator has a positive input terminal configured to input the second threshold voltage, and a negative input terminal configured to input the output voltage output by the output terminal.

4. The low dropout regulator according to claim 2, wherein the digital regulator circuit comprises a counting circuit, a decoding circuit, and an array of transistors, wherein the counting circuit is communicatively connected to the comparison circuit and is configured to generate a third control signal according to the comparison result of the comparison circuit and the high frequency clock signal, and wherein the decoding circuit is communicatively connected to the counting circuit and is configured to control a number of transistors to be turned on in the array of transistors according to the third control signal.

5. The low dropout regulator according to claim 4, wherein the transistors in the array of transistors comprise P-channel metal oxide semiconductor transistors, and/or N-channel metal oxide semiconductor transistors, and/or thin film transistors.

6. The low dropout regulator according to claim 4, further comprising: a feedback resistor network and a capacitor, wherein the feedback resistor network has a first terminal connected to the output terminal of the low dropout regulator, and a second terminal connected to the ground, and is configured to shunt current output by the output terminal of the low dropout regulator; and wherein the capacitor has a first terminal connected to the output terminal of the low dropout regulator, and a second end connected to the ground, and is configured to regulate the voltage output by the output terminal of the low dropout regulator.

7. The low dropout regulator according to claim 2, wherein the analog regulator circuit comprises an amplifying circuit and a power transistor, wherein the amplifying circuit has a positive input terminal configured to input the reference voltage, and a negative input terminal configured to input the output voltage output by the output terminal, and is configured to amplify the reference voltage and the output voltage, and wherein the power transistor is communicatively connected to the amplifying circuit and is configured to generate the feedback current according to the amplified reference voltage and the amplified output voltage.

8. A method for controlling a low dropout regulator of claim 1, the method comprising:

receiving an output voltage output by the output terminal of the low dropout regulator, a first threshold voltage, a second threshold voltage, and a reference voltage;

comparing the output voltage with the first threshold voltage and comparing the output voltage with the second threshold voltage;

generating a first control signal in a state where the output voltage is less than the first threshold voltage or greater than the second threshold voltage;

adjusting the output voltage according to the first control signal so that the output voltage is equal to the reference voltage;

generating a second control signal in a state where the output voltage is greater than the first threshold voltage and less than the second threshold voltage;

maintaining the output voltage according to the second control signal; and outputting feedback current to the output terminal according to the output voltage and the reference voltage under the trigger of the second control signal to reduce an output ripple;

wherein the reference voltage is greater than the first threshold voltage, and the reference voltage is less than the second threshold voltage.

9. The method according to claim 8, wherein generating a first control signal in a state where the output voltage is less than the first threshold voltage or greater than the second threshold voltage comprises:

outputting a first code in a state where the output voltage is less than the first threshold voltage or greater than the second threshold voltage; and generating a first control signal comprising a high frequency clock signal and a first signal for controlling all the plurality of switches to be turned off according to the first code, and wherein adjusting the output voltage according to the first control signal comprises:

generating a third control signal according to a comparison result of the comparison circuit and the high frequency clock signal; and controlling a number of transistors to be turned on in the array of transistors according to the third control signal.

10. The method according to claim 8, wherein generating a second control signal in a state where the output voltage is greater than the first threshold voltage and less than the second threshold voltage comprises:

outputting a second code in a state where the output voltage is greater than the first threshold voltage and less than the second threshold voltage; and generating the second control signal comprising an intermediate frequency clock signal and a second signal for controlling all the plurality of switches to be turned on according to the second code, wherein maintaining the output voltage according to the second control signal comprises:

maintaining the output voltage according to the intermediate frequency clock signal; and wherein outputting feedback current to the output terminal according to the output voltage and the reference voltage comprises:

amplifying the reference voltage and the output voltage; and generating the feedback current according to the amplified reference voltage and the amplified output voltage.

* * * * *